United States Patent [19]

Heimbrock

[11] 4,114,971

[45] Sep. 19, 1978

[54] CLUSTER ASSEMBLY AND BLOCK THEREFOR

[75] Inventor: Henry H. Heimbrock, Cincinnati, Ohio

[73] Assignee: Van Products, a Division of Standex International Corporation, Andover, Mass.

[21] Appl. No.: 728,386

[22] Filed: Sep. 30, 1976

[51] Int. Cl.[2] ..... H01R 13/42

[52] U.S. Cl. ..... 339/59 R; 339/192 RL; 339/210 R

[58] Field of Search ..... 339/59 R, 59 M, 192 R, 339/192 L, 210, 61 R, 61 M

[56] References Cited

U.S. PATENT DOCUMENTS

| | | | |
|---|---|---|---|
| 2,875,426 | 2/1959 | Skony | 339/192 RL |
| 3,332,053 | 7/1967 | Busler | 339/210 R |
| 3,519,978 | 7/1970 | Taormina | 339/59 M |
| 3,764,960 | 10/1973 | Heimbrock | 339/192 RL |
| 4,012,098 | 3/1977 | Tolnar | 339/61 R |
| 4,018,981 | 4/1977 | Hawkins | 339/210 R |

FOREIGN PATENT DOCUMENTS

| | | | |
|---|---|---|---|
| 1,315,693 | 5/1973 | United Kingdom | 339/59 M |

*Primary Examiner*—Neil Abrams
*Attorney, Agent, or Firm*—Wood, Herron & Evans

[57] ABSTRACT

A cluster assembly in which three connector clips, each having a pin-receiving receptacle, are disposed equiangularly in a block for application to a three pinned header. The block has a transverse pin-receiving hole and an opposed detent-receiving opening communicating with each of three longitudinal clip-receiving passageways and includes a cap hinged at one end to the block having integral detents adapted to project through the detent-receiving openings and be locked therein to retain the clips in the passageways with the pin-receiving receptacles of the clips aligned with the pin-receiving holes in the block.

20 Claims, 6 Drawing Figures

CLUSTER ASSEMBLY AND BLOCK THEREFOR

BACKGROUND OF THE INVENTION

This invention relates tc a cluster assembly constituted by an insulative block and a plurality of connector clips disposed in the block in spaced relation to each other, the assembly being adapted to be applied to a plurality of conductive terminal pins. The cluster assembly is generally of the type disclosed in U.S. Pat. Nos. 3,101,985; 3,206,715; 3,566,341; 3,764,960; and 3,853,388; all of which are assigned to the assignee of the present invention.

Cluster assemblies of this type have principal application to a hermetically sealed compressor for use in refrigeration and air conditioning. The compressor consists of a hermetically sealed housing within which is contained the compressor and a motor for driving the compressor. A glass-to-metal seal or a header is fixed in the housing wall and provides three conductive pins extending from the inside to the outside of the housing wall to which electrical connection is made to supply power to the motor within the housing.

A cluster assembly comprises an insulative block or housing having three connector clips mounted within the block with the clip leads projecting from the block. In practice, the cluster assembly is shipped to a motor manufacturer and the leads projecting from the cluster assembly are connected to the three input leads of the motor. The motor with leads attached is shipped to a compressor manufacturer where the motor is assembled in the compressor unit and the cluster assembly is applied to the three terminal pins on the interior of the compressor housing. During the assembly process, the cluster assembly is applied to the pins a number of times, for example, at various testing stages and, of course, on the compressor unit itself. Thus, it is of primary importance that the cluster assembly have a high degree of reliability to be able to withstand the rigors of the assembly process. Among other things, it is of primary importance that the connector clips be securely locked in the cluster block to resist pullout of the clips from the block at the various stages in the assembly process.

It has been an objective of the invention to provide a cluster assembly which provides improved resistance to pullout of the connector clips from the block forming a housing for the connector clips. The cluster assembly of the invention is particularly adapted to be applied to three bare pins of a header.

Another objective of the invention has been to provide a secure lock for each clip within the insulative block, the block including detents integral with a cap hinged to the block and adapted to project into the clip-receiving passageways of the block to securely retain the clips in the passageways. The cap is capable of being locked to the block with the detents projecting into the clip-receiving passageways and of being unlocked to permit removal of the clips from the block without damaging the clips.

Another objective of the invention has been to provide a cluster assembly which is of much simpler construction and which may be simply and economically manufactured, all with improved reliability of locking of the clips in the block. More particularly, it has been an objective of the invention to provide an integrally molded insulative block and cap having improved clip-locking capability.

Another objective of the invention has been to provide a cluster assembly in which the detents on the cap cooperate with abutment means in the longitudinal passageways of the block to align the pin-receiving receptacles of the connector clips with the pin-receiving openings of the block.

Another objective of the invention has been to provide an insulative block for receiving connector clips to form a cluster assembly wherein the block includes an integrally molded cap having integral detents adapted to project into the clip-receiving passageways to retain the clips in the passageways with the pin-receiving receptacles of the connector clips being aligned with the pin-receiving openings of the block, at least one of the detents including an integral locking lip adapted to project into the passageway to lock the cap to the block.

SUMMARY OF THE INVENTION

The objectives of the present invention are attained by providing an insulative cluster block having three longitudinal passageways adapted to receive the connector clips and a transverse pin-receiving hole and an opposed detent-receiving opening communicating with each passageway. A cap molded integrally with the block and hinged at one end to the block carries three detents, in spaced relation to each other, each detent being adapted to project through a detent-receiving opening on closing of the cap. At least one of the detents includes an integral locking lip and is adapted to flex on passing through its respective opening and then spring back whereby the locking lip engages the block in the passageways and locks the cap to the block. In one embodiment, the two outward detents carry lateral locking lips. In another embodiment, all three detents include locking lips which extend across the clip-receiving passageways to lock the cap to the block.

The detents provide rearward abutments to prevent pullout of the connector clips from the block and further cooperate with forward abutments in the passageways to align the clip receptacles with the pin-receiving openings and securely lock the clips in position in the block.

The clip of the cluster assembly is of known design and includes a ferrule adapted to connect the clip to a lead wire and a receptacle constituted by a bottom wall having a pin-receiving hole in it and two side walls projecting perpendicularly from the bottom wall, the side walls being aligned on either side of the hole. The hole is preferably rectangular. The smaller dimension of the hole and spacing of the side walls is a few thousandths of an inch smaller than the diameter of the pin which the receptacle is designed to receive so that there is a press fit connection between the pin and the clip. The side walls are planar and lie parallel to each other so that it is possible for the connector clip to rock back and forth with respect to the pin to which it is applied without any stress on the metal whatsoever which would tend to plastically deform it.

These and other objectives of the invention will become more readily apparent from the following detailed description taken in conjunction with the accompanying drawings.

DETAILED DESCRIPTION OF THE INVENTION

Figure 1:
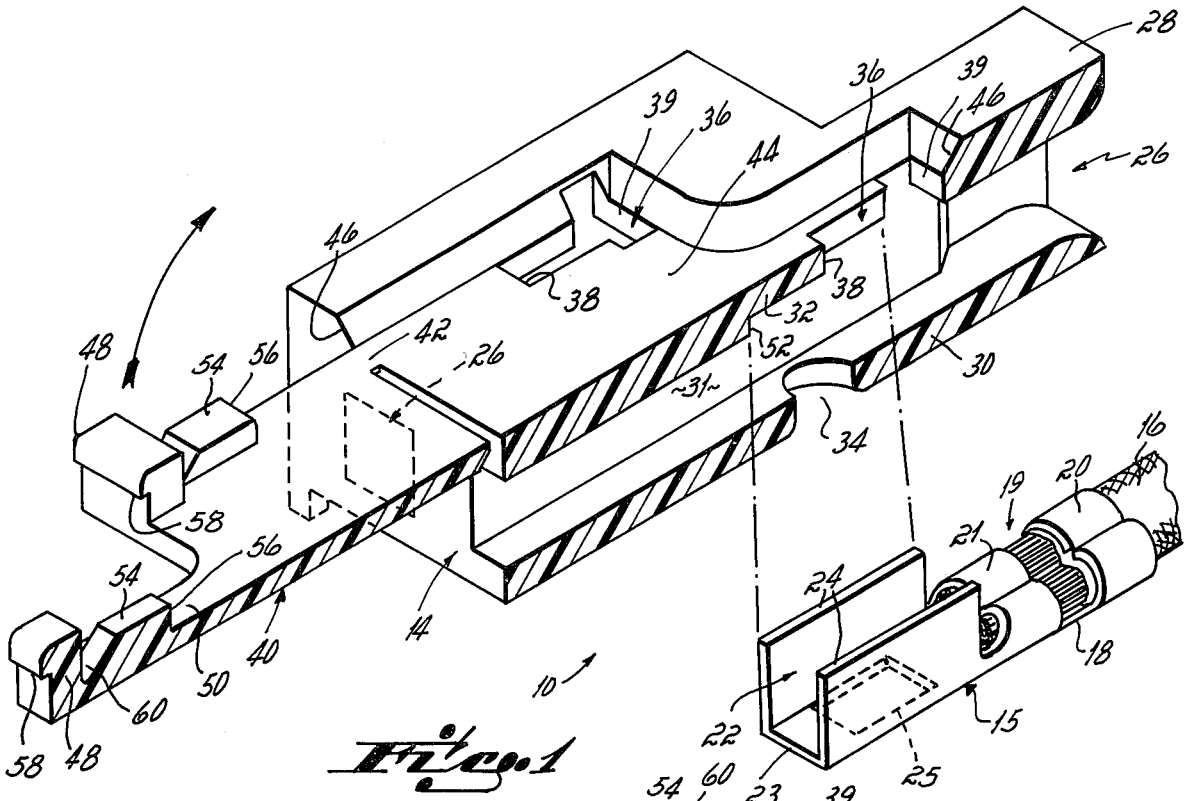
FIG. 1 is a perspective view partly in section showing a cluster assembly according to one embodiment of the present invention.
Figure 2:
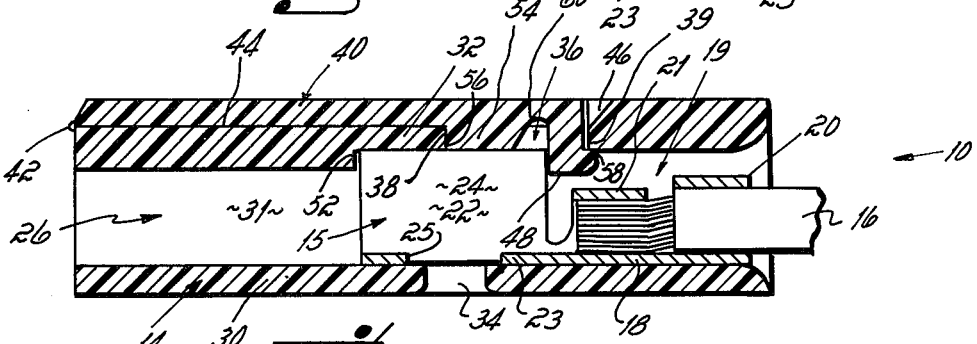
FIG. 2 is a cross-sectional view through one passageway of the cluster assembly shown in FIG. 1 illustrating the connector clip locked in the cluster block.

The cluster assembly illustrated at 10 is adapted to be applied to pins 11 forming a part of a glass-to-metal seal or header 12, the header being mounted on a hermetically sealed casing for a motor compressor unit. The cluster assembly includes a cluster block 14 and three clips 15 each having a lead wire 16 attached to it. Each clip includes a shank 18 having a wire gripping ferrule 19 having an insulation gripping portion 20 and a bare wire gripping portion 21. At the opposite end of the shank 18 is the receptacle 22 which includes a bottom wall 23 and two upwardly projecting side walls 24. A rectangular hole 25 is formed in the bottom wall 23. The hole has a transverse dimension equal to the distance between the side walls 24 and a longitudinal dimension substantially greater than the transverse dimension. The transverse dimension of the hole 25 and the distance between the side walls 24 is slightly less than the diameter of the pins 11 onto which the clip is pressed. For example, the one widely used pin size is 0.090 inch and the hole is dimensioned 0.083″/0.087″, being approximately 0.005 inch less than the diameter of the pin so as to require a press fit when the clip is applied to the pin.

The cluster block 14 in which the clips are mounted is an integral unit having three longitudinal passageways 26. Preferably the block is integrally molded of a hard insulative plastic, although the particular material used is a matter of choice. The outward passageways are identical to each other and are identical to the center passageway except that the center passageway is displaced rearwardly of the assembly to permit the pin-receiving clips to be spaced equiangularly, thereby creating a rearward extension 28 of the block 14. Each passageway 26 has a bottom wall 30, side walls 31 and a top wall 32. The bottom wall 30 has a circular hole 34 transverse to each longitudinal passageway 26 extending from one outer surface of the cluster block 14 to each passageway 26 through which the pin 11 passes to be received by the clip 15. The top wall 32 has a T-shaped opening 36 having front and rear walls 38 and 39, respectively. The opening 36 likewise extends transverse to each longitudinal passageway 26 from the opposite outer surface of the cluster block 14.

At the forward end of the block 14 is a cap 40. The cap 40 is attached to the block 14 by a pair of integrally molded hinges 42 at the outer edges thereof and is adapted to swing about the hinges 42 (in the direction of the arrow in FIG. 1) and seat in a recess 44 in the cluster block 14. The recess 44 in the cluster block may be chamfered as at 46 to facilitate this seating. The cap 40 carries three detents 48 spaced one from another so as to project through the equiangularly disposed detent-receiving openings 36 when the cap 40 is seated in the recess 44. Since the block 14 has a rearward extension 28, the cap 40 likewise includes an extension 50 carrying one of the detents 48.

The cap 40 further includes three blocks 54, in spaced relation to the detents 48, which are positioned such that their ends 56 engage the front walls 38 of the detent-receiving openings 36 when the cap 40 is seated and locked. Each of the detents 48 includes a locking lip 58 adapted to engage the top wall 32 of the passageway 26 to lock the cap 40 on the block 14 in the recess 44 with the outer surface thereof being flush with the outer surface of the cluster block. A groove 60 is provided at the base of each detent between the detent 48 and block 54 to permit the detent to flex inwardly as it passes through the detent-receiving opening 36 to permit passing of the locking lip 58 therethrough. When the lip 58 passes through the opening 36 the resiliency of the material forming the detent springs the detent rearwardly and the locking lip 58 thereby engages the cluster block 14 in the passageway 26 to lock the cap 40 on the block 14. The engagement of the wall 56 of the cap block 54 with the front wall 38 of the detent-receiving opening 36 provides the resisting force to the flexing force on the detent 48 as it passes through the opening 36 thereby removing any forces on the hinges 42 or cap 40 which might cause flexing or distortion of those elements. The blocks 54 further resist sliding movement of the cap 40 in a direction that would release the detents. The detent 48 is rounded at its forward end to facilitate is passing through the opening 36.

In assembling the connector clips 15 in the cluster block 14 to form the cluster assembly 10, each of three clips with lead wires attached is inserted in the longitudinal passageway 26 up against forward abutment 52 in the passageway 26 so disposed that the hole 25 in the clip 15 is aligned with the hole 34 in the block 14. The cap 40 is then swung about its hinges 42 and the detents 48 are forced through the detent-receiving openings 36. On passing through the openings 36, the detents flex inwardly and, once through, spring back into locking engagement in the passageways 26. The detent 48 projecting into the passageway 26 provides a rearward abutment adjacent the rear of the clip receptacle 22 which cooperates with the forward abutment 52 in the passageway to maintain alignment of the pin-receiving hole 25 in the receptacle 22 with the pin-receiving hole 34 in the cluster block 14. The width of the detent 48 is greater than the distance between the outer surfaces of the receptacle side walls 24, and thus the detent extends across the receptacle and prevents rearward pullout of the clip. The forward abutment likewise prevents forward movement of the clip. Any attempt to pull the clip out of the passageway merely pushes the detent into even greater locking engagement with the block. However, should it be desired to remove the clips from the block, for example, for reworking of the clips, the cap can be unlocked by inserting a tool to flex the detents inwardly until the locking lip is disengaged at which point the cap can be swung off the block. The clips may then be simply slid out of the block without being subjected to any deforming force whatsoever.

With the clip secured in its respective passageway, the rectangular hole 25 overlies the circular pin-receiving hole 34 and is thus in position for application to a pin projecting through the two holes. The side walls 24 being planar and lying parallel to each other and the longitudinal dimension of the hole 25 extending along the passageway 26 permits the connector clip to rock back and forth with respect to the pin to which it is applied withou t any stress to the metal which would tend to plastically deform it. The detent-receiving openings 36 are slightly offset longitudinally with respect to the opposed pin-receiving hole 34. Thus, on application to a header, at least a portion of the pin projecting through the two holes and into the passageway abuts the top wall 32 of the passageway and thus cannot spring the cap 40 out of locking engagement.

Figure 3:
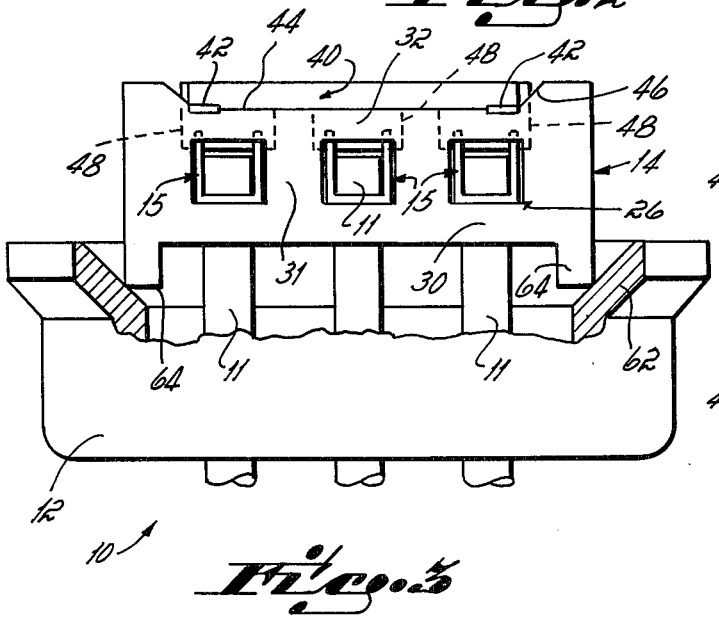
FIG. 3 is an end view of the cluster assembly shown in FIG. 1 illustrating the assembly as applied to a header.
Figure 4:
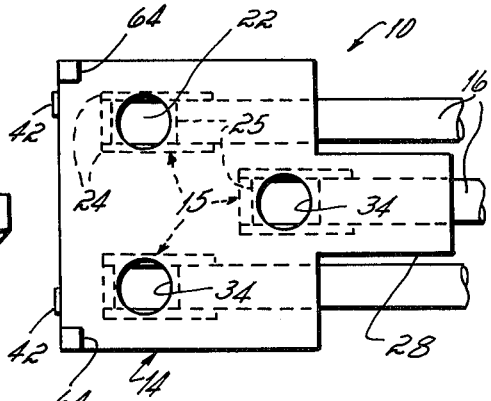
FIG. 4 is a plan view of the cluster assembly shown in FIG. 1.

When the clips are in place, the cluster assembly is ready for mounting onto the three pins 11 of a header 12 as shown in FIG. 3. When mounted on the header, the rearward extension 28 of the cluster block which forms the central longitudinal passageway rests upon the skirt 62 of the header 12. The forward end of the cluster block has a foot 64 at each corner, the feet projecting down into the header and resting on the interior surface of the skirt 62 thereby maintaining the cluster block level or flush with the edge of the skirt.

Figure 5:
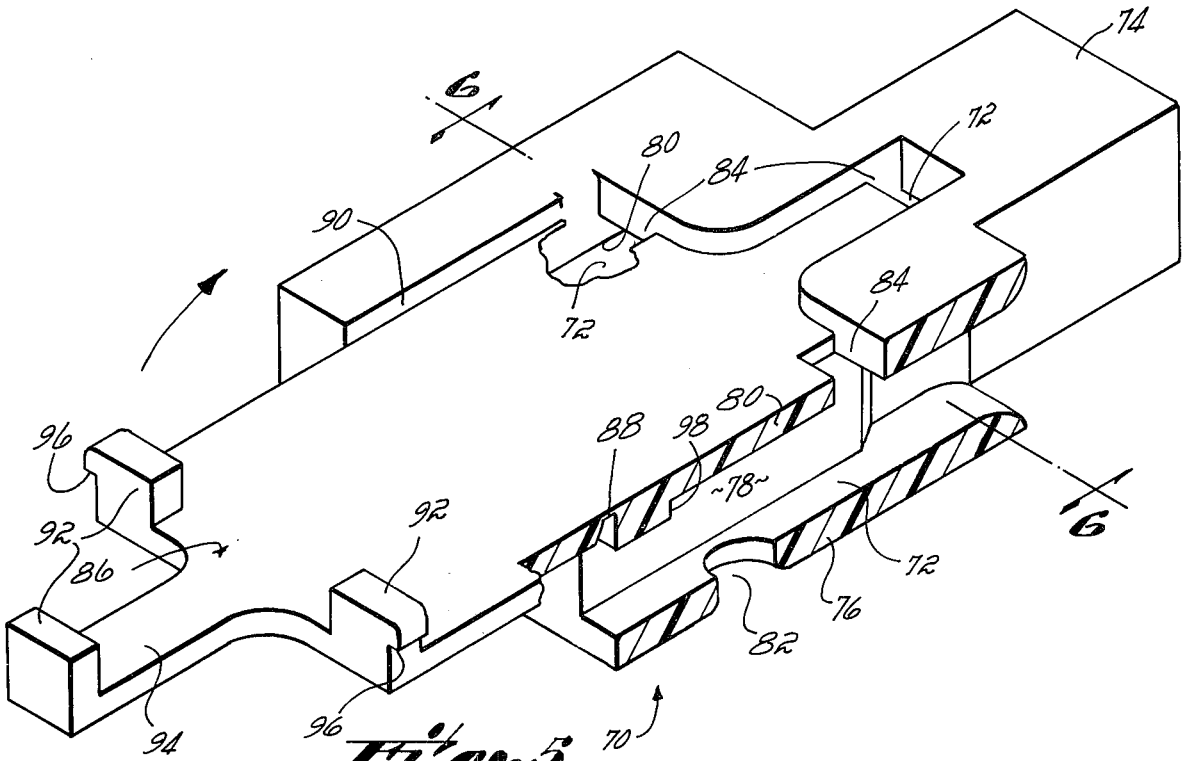
FIG. 5 is a perspective view partly broken and partly in section of another embodiment of the present invention.
Figure 6:
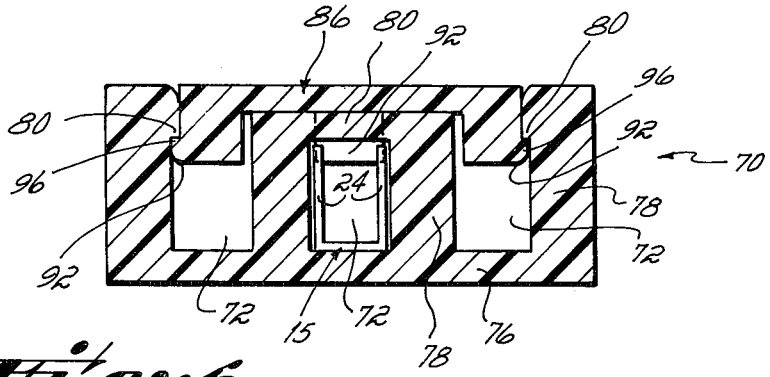
FIG. 6 is a view taken along line 6—6 of FIG. 5 with the cap locked in place on the cluster block.

Referring now to FIGS. 5 and 6, there is shown another embodiment of the invention which includes a cluster block 70 having three longitudinal passageways 72 for receiving the connector clips 15. Preferably the block is integrally molded of a hard insulative plastic, although the particular material used is again a matter of choice. The outward passageways are identical to each other and are identical to the center passageway except that the center passageway is again displaced rearwardly of the assembly to permit the pin-receiving clips 15 to be spaced equiangularly, thereby creating a rearward extension 74 of the block 70. Each passageway 72 has a bottom wall 76, side walls 78 and a top wall 80. The bottom wall 76 has a circular hole 82 transverse to each longitudinal passageway 72 extending from one outer surface of the cluster block 70 to each passageway 72 through which the pin 11 passes to be received by the clip 15. The top wall 80 has a rectangular detent-receiving opening 84. The openings 84 likewise extend transversely to each longitudinal passageway 72 from the opposite outer surface of the cluster block 70.

At the forward end of the block 70 is a cap 86. The cap 86 is attached to the block 70 by means of an integrally molded hinge 88 extending across its width and is adapted to swing about the hinge 88 (in the direction of the arrow in FIG. 5) and seat in a recess 90 in the cluster block 70. The cap 86 carries three detents 92 spaced one from another so as to project through the equiangularly disposed detent-receiving openings 84 when the cap 86 is seated in the recess 90. Since the block 70 has a rearward extension 74, the cap 86 likewise includes an extension 94 carrying one of the detents 92.

Each of the two outward detents 92 includes a locking lip 96 adapted to engage the top wall 80 of its respective passageway 72 along an outward edge to lock the cap 86 on the block 70 in the recess 90 with the outer surface thereof being flush with the outer surface of the cluster block and with all of the detents 92 extending into the passageway 72 (FIG. 6). In this embodiment, locking lips are formed on only two of the detents 92, this being sufficient to lock the cap on the block. Moreover, the locking lips now project laterally of the cap 86 such that when the cap is locked to the block the lips 96 extend along a portion of the length of the passageway, i.e., in a direction parallel to the direction of the longitudinal passageways 72, rather than across or transverse to the longitudinal passageways as in the embodiment shown in FIGS. 1–4. The detents 92 are again rounded to facilitate passing of the locking lips 96 through the openings 84 with the two outward detents 92 flexing inwardly as they pass through the detent-receiving openings 84 to permit passing of the locking lips 96 therethrough. When the lips 96 pass through the openings 84, the resiliency of the material forming the detents springs the detents outwardly and the locking lips 96 thereby engage the cluster block 70 in the passageways 72 to lock the cap 86 on the block 70.

The embodiment shown in FIGS. 5 and 6 is particularly advantageous in that it permits greater tolerances in the manufacture of the cluster block. This is, in the embodiment shown in FIGS. 1–4 it is necessary to accurately control certain manufacturing tolerances, the critical dimensions being the distance from the hinges 42 to the three detents 48 as well as the disposition of the detent-receiving openings and of the blocks 54. For example, should the extension 50 carrying the center detent 48 be formed slightly too long, or too short, the detent 48 and block 54 will not be aligned with its detent-receiving opening when the cap is swung onto the block thus preventing any of the detents from entering the passageways and preventing locking of the cap to the block. In the embodiment shown in FIGS. 5 and 6, the detent-receiving openings can be oversized thereby minimizing the criticality of the longitudinal dimension. In this embodiment, it is necessary only to control the tolerances between the outward detents and detent-receiving openings, which is the shorter transverse direction and is easier to accomplish from a manufacturing standpoint. Moreover, it will be noted that in this embodiment, the blocks 54 have been eliminated since the outward detents 96 flex inwardly on passing through the openings 84; and, consequently, there are no forces on the hinge 88. Further, since the cap 86 nests in the recess 90, as shown most clearly in FIG. 6, movement of the cap in a direction that would release the locking lips 96 is prevented.

In assembling the connector clips 15 in the cluster block 70 to form the cluster assembly in this embodiment, each of three clips with lead wires attached is inserted in the longitudinal passageway 72 up against a forward abutment 98 in the passageway 72 so disposed that the hole 25 in the clip 15 is aligned with the hole 82 in the block 70. The cap 86 is then swung about its hinge 88 and the outward detents 92 are forced through the detent-receiving openings 84. The center detent not having a locking lip is merely projected through its opening on swinging of the cap into place on the block. On passing through the openings 84, the detents flex inwardly and, once through, spring back outwardly into locking engagement in the passageways 72. The detents 92 projecting into the passageways 72 provide rearward abutments adjacent the rear of the clip receptacles 22 which cooperates with the forward abutments 98 in the passageways to maintain alignment of the pin-receiving holes 25 in the receptacles 22 with the pin-receiving holes 82 in the cluster block 70. The width of the detents 92 is greater than the distance between the outer surfaces of the receptacles side walls 24, and thus the detents extend across the receptacles and prevent rearward pullout of the clips. The forward abutments likewise prevent forward movement of the clips. However, should it be desired to remove the clips from the block, for example, for reworking of the clips, the cap can be unlocked by inserting a tool to flex the outward detents inwardly until the locking lips are disengaged at which point the cap can be swung off the block. The clips may then be simply slid out of the block without being subjected to any deforming force whatsoever.

When the clips are in place, the cluster assembly is ready for mounting onto the three pins 11 of a header 12 in the same manner as described above in relation to FIG. 3.

Although the invention has been described in terms of certain preferred embodiments, it will be recognized that other forms may be adopted by those skilled in the art within the scope of the invention.

Thus having described the invention, I claim:

1. A block for a cluster assembly, comprising, an insulative housing having at least one longitudinal clip-receiving passageway, a transverse pin-receiving hole and a transverse detent-receiving opening extending from the outer surface of said housing to said passageway, and a cap having an integral detent depending from a surface thereof and adapted to project through said detent-receiving opening to prevent rearward longitudinal removal of a clip from said passageway, said detent including a locking lip adapted to project into said passageway to lock said cap to said housing, a surface of said detent-receiving opening being rearward of said detent and forming means to limit rearward flexing of said detent after said detent is received in said opening.

2. The block as in claim 1 wherein said locking lip extends across said longitudinal passageway.

3. The block as in claim 1 wherein said locking lip extends along said longitudinal passageway.

4. A block as in claim 1 in which each detent-receiving opening is formed as a T-shaped slot having a longitudinal stem and a transverse cross bar, said detent fitting into the cross bar portion of said slot, said cap having an elongated block adjacent each said detent and adapted to fit into the stem portion of said slot to resist sliding movement of said cap in a direction which would release said detent.

5. The block as in claim 1 wherein said housing includes three longitudinal passageways and a pin-receiving hole extending from the outer surface of said housing to each passageway, and wherein each said pin-receiving hole is equiangularly disposed from the other.

6. A block for a cluster assembly as in claim 1 wherein said cap is hinged at one end of said housing.

7. A block for a cluster assembly, comprising, a molded insulative housing having at least one longitudinal clip-receiving passageway, a transverse pin-receiving hole and a transverse detent-receiving opening extending from the outer surface of said housing to said passageway, and an integrally molded cap hinged at one end of said block having a flexible integral detent depending from a surface thereof and adapted to project through said detent-receiving opening into said passageway said detent including a locking lip adapted to project into said passageway to lock said cap to said housing to prevent rearward longitudinal removal of a clip from said passageway, a surface of said detent-receiving opening being rearward of said detent and forming means to limit rearward flexing of said detent after said detent is received in said opening.

8. A block for a cluster assembly, comprising, a housing having at least one longitudinal passageway opening at one end of said housing for receiving a connector clip, said connector clip having a pin-receiving opening, said housing having a transverse pin-receiving hole and a transverse detent-receiving opening extending from the outer surface of said housing to said passageway, abutment means at one end of said passageway for aligning said pin-receiving opening with said pin-receiving hole, and a cap having an integral detent depending from a surface thereof and adapted to project through said detent-receiving opening to maintain the alignment of said pin-receiving opening with said pin-receiving hole and to prevent rearward longitudinal removal of said clip from said housing, said detent having a locking lip engageable with said housing in said passageway to lock said cap on said housing, a surface of said detent-receiving opening being rearward of said detent and forming means to limit rearward flexing of said detent after said detent is received in said opening.

9. The block of claim 8 wherein said block is integrally molded of an insulative material and said cap is hinged at one end of said housing.

10. A block for a cluster assembly comprising an insulative housing having three longitudinal passageways opening at one end of said housing for receiving connector clips, each said connector clip having a pin-receiving opening, said housing having a transverse pin-receiving hole extending from one outer surface of each said passageway and a detent-receiving opening extending from the opposite outer surface to each said passageway, abutment means in each said passageway for aligning said pin receiving opening with said pin-receiving hole, and an integrally molded cap hinged at one end of said housing, said cap having integral detents depending from a surface thereof and adapted to project through said detent-receiving openings to maintain the alignment of each said pin-receiving opening with its respective pin-receiving hole and to prevent rearward longitudinal removal of said clips from said passageways, at least one of said detents having an integral locking lip engageable with said housing to lock said cap on said housing, each said detent having a locking lip being adapted to flex when thrust through its respective detent-receiving opening to permit said locking lip to enter said passageway, a surface of said detent-receiving opening being rearward of said detent end forming means to limit rearward flexing of said detent after said detent is received in said opening.

11. The block of claim 10 wherein said pin-receiving hole of said housing and said opposed detent-receiving opening are longitudinally offset.

12. The block of claim 10 wherein said locking lip extends across said longitudinal passageway.

13. The block of claim 10 wherein said detents comprise a pair of outward detents and a middle detent, said outward detents having said locking lips, said locking lips extending along said longitudinal passageways.

14. The block of claim 10 wherein said housing has a recess in the surface thereof of a depth substantially equal to the thickness of said cap for receiving said cap so as to form a substantially smooth outer surface when said cap is locked on said housing.

15. A cluster assembly comprising, a block of insulative material, at least one longitudinal clip-receiving passageway in said block, a transverse pin-receiving hole and a transverse detent-receiving opening extending from the outer surface of said block to said passageway, a clip including a pin-receiving receptacle and a ferrule to which a lead wire is attached disposed in said passageway, and a cap having an integral detent depending from a surface thereof and adapted to project through said detent-receiving opening into said passageway to prevent rearward longitudinal removal of said clip from said passageway, said detent including a locking lip adapted to project into said passageway to lock said cap to said housing, a surface of said detent-receiving opening being rearward of said detent and forming means to limit rearward flexing of said detent after said detent is received in said opening.

16. The cluster assembly of claim 15 wherein said locking means comprises a locking lip integral to said detent extending across said longitudinal passageway.

17. The cluster assembly of claim 15 wherein said locking means comprises a locking lip integral to said detent extending along said longitudinal passageway.

18. A cluster assembly of application of a three-pin header comprising, a block of insulative material having three longitudinal passageways opening at one end thereof, said block having a transverse pin-receiving hole extending from one outer surface to each said passageway and a detent-receiving opening extending from the opposite outer surface to each said passageway, a connector clip in each said passageway, said clip comprising a shank, a ferrule at one end of said shank to crimp said clip to a lead wire, and a receptacle for said pin at the opposite end of said shank including a bottom wall constituting an extension of said shank and having a pin-receiving opening, said opening being generally rectangular and having transverse and longitudinal dimensions, said receptacle having two spaced parallel side walls one at each side of said opening and projecting perpendicular to said bottom wall, said side walls being spaced apart a distance equal to the transverse dimension of said opening, abutment means in each said passageway for aligning said pin-receiving opening of said receptacle with said pin-receiving hole of said block, and an integrally molded cap hinged at one end of said block, said cap having integral detents depending from a surface thereof and adapted to project through said detent-receiving openings to prevent rearward longitudinal removal of said clips, at least one of said detents including an integral locking lip engageable with said block in said passageway to lock said cap on said block, each said detent including said locking lip being adapted to flex when thrust through its respective detent-receiving opening to permit said detent and said locking lip to enter said passageway, a surface of said detent-receiving opening being rearward of said detent and forming means to limit rearward flexing of said detent after said detent is received in said opening, aid detents cooperating with said abutment means to align said pin-receiving opening and said pin-receiving hole and to maintain said alignment.

19. The block of claim 18 wherein said detents comprise a pair of outward detents and a middle detent, said outward detents having said locking lips, said locking lips extending along said longitudinal passageways.

20. The cluster assembly of claim 18 wherein said block has a recess in the surface thereof of a depth substantially equal to the thickness of said cap for receiving said cap so as to form a substantially smooth outer surface when said cap is locked on said block.

* * * * *

UNITED STATES PATENT AND TRADEMARK OFFICE

CERTIFICATE OF CORRECTION

PATENT NO. : 4,114,971

DATED : September 19, 1978

INVENTOR(S) : Henry H. Heimbrock

It is certified that error appears in the above–identified patent and that said Letters Patent are hereby corrected as shown below:

In column 5, line 2, "withou t" should be --without--.

In column 6, line 11, "This" should be "That".

In column 6, line 59, "receptacles" should be --receptacle--.

In column 8, line 52, "end" should be --and--.

In column 9, line 28, "of" in the first instance should be --for--.

In column 10, line 28, "aid" should be --said--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*